United States Patent [19]

Huber-Krattiger

[11] 4,448,380

[45] May 15, 1984

[54] FOLDABLE CANTILEVER

[76] Inventor: Rudolf Huber-Krattiger, Hofgut Bolzenried, 2216 Bubendorf, Switzerland

[21] Appl. No.: 327,182

[22] Filed: Dec. 3, 1981

[30] Foreign Application Priority Data

Dec. 3, 1980 [CH] Switzerland ..... 8947/80

[51] Int. Cl.[3] ..... E04G 3/08

[52] U.S. Cl. ..... 248/235; 248/308; 108/125; 211/150

[58] Field of Search ..... 248/235, 240.4, 461, 248/308; 211/90, 149, 150; 108/48, 125, 80, 134

[56] References Cited

U.S. PATENT DOCUMENTS

| | | | |
|---|---|---|---|
| 511,625 | 12/1893 | Kenison et al. | 248/235 |
| 1,208,622 | 12/1916 | Muller | 248/461 |
| 1,666,409 | 4/1928 | Dalton | 248/308 |
| 1,666,410 | 4/1928 | Dalton | 248/308 |
| 1,882,939 | 10/1932 | Root | 108/125 |
| 2,471,459 | 5/1949 | Stich | 248/235 |
| 3,762,572 | 10/1973 | Hager | 211/150 |
| 3,941,250 | 3/1976 | Ott | 248/308 |

FOREIGN PATENT DOCUMENTS

| | | | |
|---|---|---|---|
| 1434384 | 10/1969 | Fed. Rep. of Germany | 248/235 |
| 622621 | 6/1927 | France | 248/240.4 |

*Primary Examiner*—Ramon S. Britts
*Assistant Examiner*—Sarah A. Lechok
*Attorney, Agent, or Firm*—Diller, Ramik & Wight

[57] ABSTRACT

The foldable cantilever comprises a supporting arm formed by a U-profile. A supporting flap extends obliquely from the web of this profile section. The supporting arm is hingedly connected to a jib. A strut is, furthermore, also hingedly connected to the jib. The supporting arm, the jib and the strut are U-shaped profile sections. In use the U-profile which forms the strut supports itself on a supporting flap formed on the web of the profile section forming the supporting arm. A strut controlled slider is arranged in the supporting arm. The strut is connected by a tension spring to the jib. This tension spring leads to the lower edge of the strut being biased against or towards, respectively, the supporting arm. Accordingly, the foldable cantilever occupys in its shipping state only a small space and it is possible to open it to its operating position by means of only one manually made movement thereof.

17 Claims, 4 Drawing Figures

FOLDABLE CANTILEVER

BACKGROUND OF THE INVENTION

1. Field of the Invention

The present invention relates to a foldable cantilever having a supporting arm, a jib and a strut extending between said supporting arm and said jib.

2. Description of the Prior Art

The three main members which together form a cantilever describe or define, respectively, by nature a triangle. Such triangle is obviously considerably space consuming during storage and shipment thereof and in order to solve this problem the known cantilevers are dismounted into various single parts for storage or shipment, respectively, thereof. On job site these separate parts must be then again mounted, connected to each other. If such cantilevers are intended for a temporary installation only, for instance, expositions, they are of a foldable construction; however the hitherto known foldable cantilevers are of a complicated and expensive design.

SUMMARY OF THE INVENTION

Hence, it is a general object of the present invention to provide an improved construction of a foldable cantilever which overcomes mentioned drawbacks.

Another object of this invention aims at the provision of a new and improved construction of a foldable cantilever which is extremely simple in construction and design, reliable in operation, economical to manufacture, and dependable in use.

Now, in order to implement these and still further objects of the invention, which will become more readily apparent as the description proceeds, the foldable cantilever of this development is manifested by the features that its jib is hingedly mounted to its supporting arm and its strut is hingedly mounted to the jib and removably supported in said supporting arm.

According to the preferred embodiment the supporting arm of the foldable cantilever is formed by a first, said jib by a second and said strut by a third profile section whereby each profile section is a U-profile having each a web and two legs each projecting at a right angle therefrom wherein the inner width of the first profile section exceeds the outer width of said second profile section; whereby the inner width of said second profile section exceeds the outer width of said third profile section; further whereby said first profile section is hingedly mounted at one end by means of a pivot pin to one end of the second profile section, which pivot pin extends through said legs of said first and said second profile section; and wherein said third profile section is hingedly mounted at one end by means of a further pivot pin to said second profile section, which pivot pin extends through the legs of the third and the second profile section; furthermore, a supporting flap thereof projects obliquely from the web of the first profile section at a location intermediate its legs; the end edge of said web of said third profile section is located remote of said pivot pin and engages supportingly into the space defined between the obliquely projecting supporting flap and the web portion located thereunder.

BRIEF DESCRIPTION OF THE DRAWINGS

The invention will be better understood and objects other than those set forth above will become apparent when consideration is given to the following detailed description thereof. Such description makes reference to the annexed drawings, wherein.

DETAILED DESCRIPTION OF THE PREFERRED EMBODIMENT

Figures 1, 2:
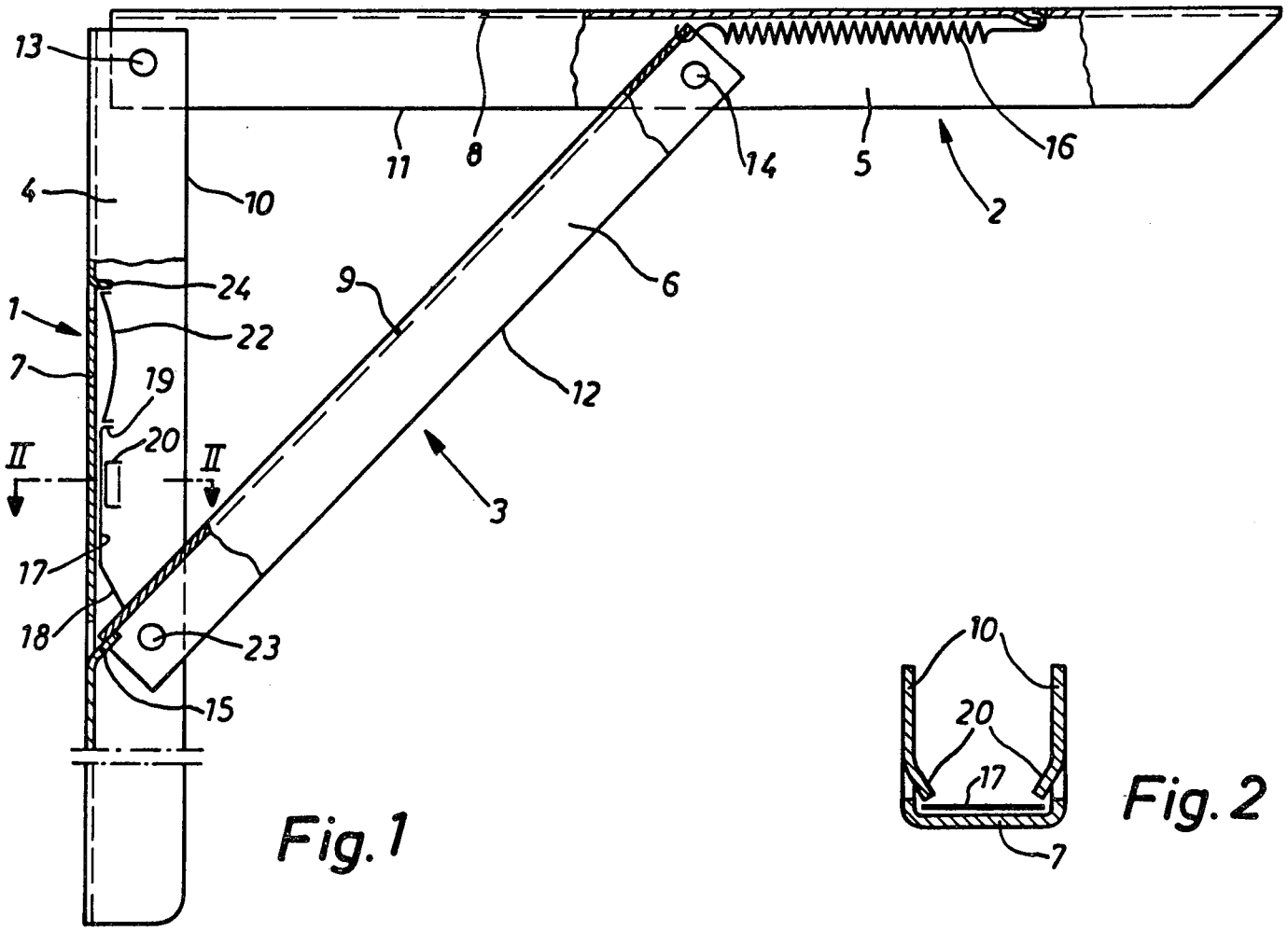
FIG. 1 is a side view of a foldable cantilever in its operational position shown partly in section.
FIG. 2 is a section along line II—II of FIG. 1.

The foldable cantilever or bracket shown in FIG. 1 comprises a supporting arm or first member 1, a jib or second member 2 and a strut or third member 3. The foldable cantilever is intended to be mounted to a wall or a carrier frame by means of its supporting arm 1. The jib is intended to carry loads and may be, for instance, supporting a shelf board. The supporting arm 1 is a U-profile 4 having a web 7 and legs 10 projecting therefrom (see also FIG. 2). The jib 2 is a U-profile 5 having a web 8 and legs 11 and the strut 3 is a U-profile 6 having a web 9 and legs 12. The dimensions specifically of the webs 7, 8, 9 are chosen such that the inner width of the profile section 4, i.e. the distance between its legs 10 is larger than the outer width of the profile section 5 whereby the outer width of the profile section 6 is smaller than the inner width of the profile section 5, i.e. the distance between its legs 11. Accordingly, the three profile sections may be in their folded state arranged nested in each other. The profile section 5 of the jib 2 is hingedly connected to the profile section 4 of the supporting arm 1 by the agency of a pivot pin or pivot means 13. Furthermore, the profile section 6 of the strut 3 is hingedly connected to the profile section 5 of the jib 2 by the agency of a further pivot pin or pivot means 14 whereby the pivot pins 13, 14 penetrate the respective legs of the respective profile sections. A through hole 23 is formed in the legs 10, 10 of the first profile section 4 and in the legs 12,12 of the third profile section 6, which holes are intended to receive a locking pin inserted there through. A slider 17 having the shape of a strip of material is arranged in the first profile section 4. This slider 17 comprises at its lower end an obliquely bent extending end section 18 and comprises at its opposite end an end section 19 projecting at a right angle thereto. From each of the legs 10 a flap like abutment 20 (see FIG. 2) is formed, which flap projects obliquely towards the inner space of the profile such that the slider 17 is slidably movable along the web 7. A nose 24 projects from this web 7 and between this nose 24 and the end section 19 of the slider 17 there is arranged a spring 22, which spring biases the slider 17 downwards. Furthermore, a supporting flap or ledge 15 projects from the web 7 into the space between the legs 10, which supporting flap extends obliquely to the web 7.

The end of the strut 3 located by the supporting arm, which strut 3 is formed by the profile section 6, is provided with a tension spring or spring biasing means 16 which engages into the second profile section 5 of the jib 2. The point of attack of the tension spring 16 at the third profile section 6 is such that this third profile section 6 is biassed against the first profile section 4 such that the end of the third profile section 6 located at the first profile section 4 is biassed in a clockwise direction; accordingly the lower end of the strut 3 is always biassed in a direction of abutting the supporting arm 1.

The operation of the foldable cantilever described above is as follows. For shipment the jib 2 is turned downwards such that it gets located completely inside of the supporting arm 1 whereby the strut 3 extends within the jib 2 and accordingly also within the supporting arm 1. Accordingly, a quite space consuming arrangement is achieved.

Figure 3:
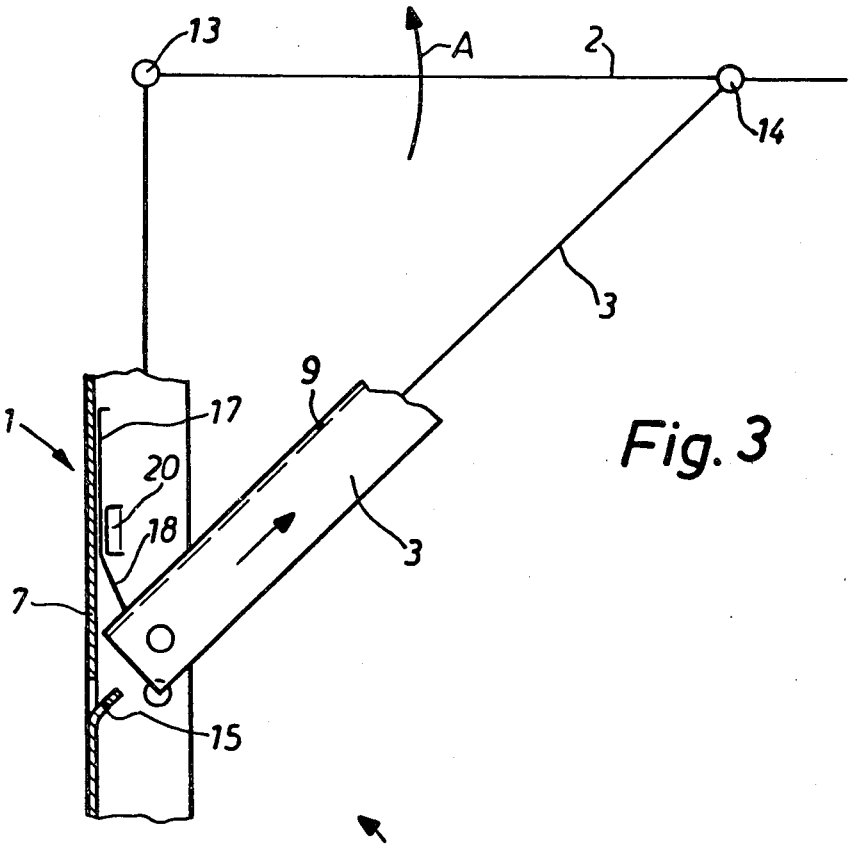
FIG. 3 is a partly schematic view of the foldable cantilever shown in FIG. 1 whereby its parts are shown in their respective positions during the unfolding of the cantilever.

Attention is now drawn to FIG. 3. In order to unfold this foldable cantilever the jib 2 is unfolded and moves accordingly the lower end of the strut 3 located inside the supporting arm 1 towards the supporting flap 15 and continues to move until it abuttingly contacts the end section 18 of the slider 17. Accordingly, the lower end of strut 3, i.e. its web 9, lies on top of the end section 18 of the slider 17. Due to the pressure spring 16 a pressure contact prevails. A continuing pivoting of the jib 2 in direction of the arrow A of FIG. 3 results in that the slider 17 due to the pressure contact is moved further upwards and is moved until the end section 18 comes to rest upon the abutments 20. Thereafter the jib 2 is pivoted downwards such that the lower end edge of the strut 3 is moved into abutment on or engagement with the ledge or flap 15 of the web 7 of the supporting arm 1 in the space between the web 7 and the legs 10 of strut 3. In this position such as shown in FIG. 1 the folding cantilever is operationable. A locking pin extending through the holes 23 can be inserted therein in order to lock the folding cantilever.

Figure 4:
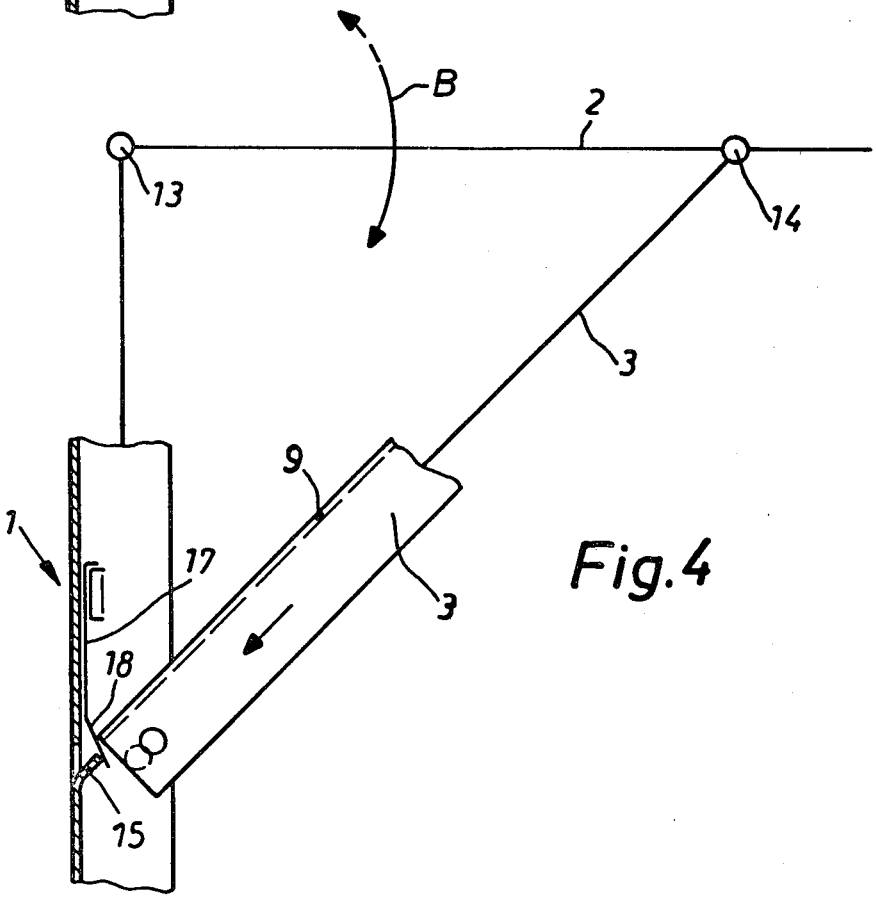
FIG. 4 is a view similar to the view of FIG. 3 whereby the relative positions of the parts are shown during the folding together of the foldable cantilever.

In order to stow away and to fold the cantilever together the jib will be initially pivoted in the direction of the interrupted section of the double arrow B of FIG. 4 such that the lower end edge of the web 7 of the strut 3 glides over the end section 18 of the slider 17. Thereafter, the jib 2 is pivoted in the direction of the section of the arrow B shown in uninterrupted line such as depicted in FIG. 4.

Because now the lower end edge of the web 9 of strut 3 lies upon the end section 18 of the slider 17, whereby this slider 17 can glide extremely easily, a downwards pivoting of the jib 2 will result in that the end section 18 of the slider 17 will be moved such that it comes to lie on top of the supporting flap 15 of the supporting arm 1. A continuing pivoting of the jib 2 downwards results in that the web 9 of the strut 3 is moved upwards along the end section 18 and accordingly is moved over and away of the supporting flap 15 such that it is now possible to pivot the jib 2 completely downwards back into the supporting arm 1.

The spring 22 shown in this preferred embodiment is not necessarily present in all practical embodiments which are being marketed. This spring 22 retained in a conventional manner (not shown), serves to bias the slider 17 against the supporting flap 15, which biassing may be advantageous for some embodiments. The spring force of this spring 22 is, however, chosen such that during a folding upwards of the jib 2 (FIG. 3) the slider 17 is at any rate movable overcoming this spring force.

While there are shown and described present preferred embodiments of the invention, it is to be distinctly understood that the invention is not limited thereto, but may be otherwise variously embodied and practiced within the scope of the following claims. ACCORDINGLY,

What is claimed is:

1. A foldable cantilever comprising a first U-profile section defined by a web and two legs with said two legs being at right angles to said web, a second U-profile section defined by a web and two legs with said last-mentioned two legs being at right angles to said last-mentioned web, a third U-profile section defined by a web and two legs with said last-mentioned two legs being at right angles to said last-mentioned web, said third U-profile section extending between said first and second U-profile sections, first means for pivotally connecting adjacent ends of said first and second U-profile sections to each other, second means for pivotally connecting an end of said third U-profile section to said second U-profile section, said U-profile sections being so dimensioned as to effect the receipt of said third U-profile section within the legs of said second U-profile section and the receipt of said second U-profile section within the legs of said first U-profile section, said first U-profile section web having a supporting flap projecting obliquely between the two legs thereof, said third U-profile section having an end remote from said second pivotally connecting means in engagement with said flap to maintain said first and second U-profile sections disposed in transverse relationship to each other, a tension spring having opposite ends, and one end of said tension spring being connected to said second U-profile section and another end of said tension spring being connected to said third U-profile section such that the tension of said tension spring biases said third U-profile section remote end between said first U-profile section legs.

2. The foldable cantilever of claim 1, wherein a slider is arranged movably between two end positions in said first profile section, which slider is controlled by said third profile section, which slider in a first of said end positions overlaps said supporting flap such to prevent said third profile section from engaging into said first profile section, and in a second of said end positions clears said supporting flap such to allow said third profile section to engage into said supporting flap.

3. The foldable cantilever of claim 2, wherein said slider is a flat strip of material located and slidably guided on a section of said web of said first profile section intermediate said supporting flap and said pivot pin, whereby the end section of said slider facing said supporting flap extends at an oblique angle in a direction away from said web, such that in the first said end position said end section of said slider overlies abuttingly said supporting flap and the opposite end section of said slider extends into the space between said legs and abuts in said first end position abutment stops formed in said first profile section.

4. The foldable cantilever of claim 3, wherein a pressure spring is inserted between said end section of said slider intended to abut said abutment stops and a supporting member formed in said first profile section, which pressure spring biasses said slider into said first end position.

5. A foldable bracket particularly adapted for supporting a shelf board or the like comprising three members each having opposite first and second ends, a first of said members being adapted to be secured to a vertical wall, a second of said members being adapted to be positioned generally normal to said first member in a first position at which a shelf board is adapted to be supported upon said second member, first pivot means for pivotally securing together first ends of said first and second members thereby effecting relative pivotal movement of said first and second members between said first position and a second position at which said first and second members are generally in side-by-side collapsed condition, second pivot means for pivotally securing together a first end of said third member and said second member, said third member being in angular spanning supporting relationship between said first and second members when said first and second members are in the first position thereof, said third member second end being in engagement with said first member when said first and second members are in the first position thereof, and means for spring biasing said third member for pivoting movement about said second pivot means in a direction urging said third member second end toward said first member.

6. The foldable bracket as defined in claim 5 wherein said spring biasing means is a tension spring.

7. The foldable bracket as defined in claim 5 wherein said spring biasing means is a tension spring connected to said third member first end and to said second member.

8. The foldable bracket as defined in claim 5 wherein said spring biasing means is a tension spring connected to said third member first end and to said second member second end.

9. The foldable bracket as defined in claim 5 including means between said third member second end and said first member for releasably interlockingly securing said third member second end and said first member when said first and second members are in said first position.

10. The foldable bracket as defined in claim 5 including means between said third member second end and said first member for releasably interlockingly securing said third member second end and said first member when said first and second members are in said first position, and said releasable interlockingly securing means includes a ledge of said first member.

11. The foldable bracket as defined in claim 5 including means between said third member second end and said first member for releasably interlockingly securing said third member second end and said first member when said first and second members are in said first position, and said releasable interlockingly securing means includes a pin insertable in aligned holes of said first and third members.

12. The foldable bracket as defined in claim 5 including means between said third member second end and said first member for releasably interlockingly securing said third member second end and said first member when said first and second members are in said first position, said releasable interlockingly securing means includes a ledge of said first member and a pin insertable in aligned holes of said first and third members.

13. The foldable bracket as defined in claim 5 wherein said releasable interlockingly securing means includes a ledge of said first member against which said third member second end engages when said first and second members are in the first position thereof, and means for preventing engagement between said third member second end and said ledge upon movement of said third member second end in a direction from said first pivot means toward said ledge.

14. The foldable bracket as defined in claim 5 wherein said releasable interlockingly securing means includes a ledge of said first member against which said third member second end engages when said first and second members are in the first position thereof, means for preventing engagement between said third member second end and said ledge upon movement of said third member second end in a direction from said first pivot means toward said ledge, said engagement preventing means having a slider in overlying relationship to said ledge and projecting therebeyond, means mounting said slider for sliding movement relative to said first member, and the third member second end being operative to contact said slider and move the slider out of overlying relationship to said ledge to effect the engagement between said third member second end and said ledge.

15. The foldable bracket as defined in claim 5 wherein said releasable interlockingly securing means includes a ledge of said first member against which said third member second end engages when said first and second members are in the first position thereof, means for preventing engagement between said third member second end and said ledge upon movement of said third member second end in a direction from said first pivot means toward said ledge, said engagement preventing means having a slider in overlying relationship to said ledge and projecting therebeyond, means mounting said slider for sliding movement relative to said first member, the third member second end being operative to contact said slider and move the slider out of overlying relationship to said ledge to effect the engagement between said third member second end and said ledge, and means for limiting the sliding movement of said slider in a direction toward said first pivot means whereby said third member second end can ride over and beyond said slider during movement toward said first pivot means after which said slider again returns to overlying relationship to said ledge.

16. The foldable bracket as defined in claim 10 wherein said ledge is inclined in a direction toward said first pivot means and sets-off an acute angle with said first member.

17. The foldable bracket as defined in claim 14 wherein said ledge is inclined in a direction toward said first pivot means and sets-off an acute angle with said first member, and said slider is inclined in a direction away from said first pivot means and sets-off an acute angle with said first member.

* * * * *